US010626806B2

(12) United States Patent
Moore et al.

(10) Patent No.: US 10,626,806 B2
(45) Date of Patent: Apr. 21, 2020

(54) PROCESS AND SYSTEM FOR CONTROLLING ENGINE SPEED

(71) Applicant: Perkins Engines Company Limited, Eastfield (GB)

(72) Inventors: Paul Moore, Peterborough (GB); William Carroll, KilCullen (IE)

(73) Assignee: Perkins Engines Company Limited, Peterborough (GB)

( * ) Notice: Subject to any disclaimer, the term of this patent is extended or adjusted under 35 U.S.C. 154(b) by 4 days.

(21) Appl. No.: 15/124,253

(22) PCT Filed: Feb. 12, 2015

(86) PCT No.: PCT/EP2015/052927
§ 371 (c)(1),
(2) Date: Sep. 7, 2016

(87) PCT Pub. No.: WO2015/139889
PCT Pub. Date: Sep. 24, 2015

(65) Prior Publication Data

US 2017/0016405 A1 Jan. 19, 2017

(30) Foreign Application Priority Data

Mar. 21, 2014 (EP) ..... 14161139

(51) Int. Cl.
*F02D 31/00* (2006.01)
*F02D 41/24* (2006.01)
(Continued)

(52) U.S. Cl.
CPC ..... *F02D 31/001* (2013.01); *F02D 31/007* (2013.01); *F02D 35/0092* (2013.01);
(Continued)

(58) Field of Classification Search
CPC .. F02D 31/001; F02D 31/007; F02D 35/0092; F02D 41/2422; F02D 2041/1418; F02D 2200/1002; F02D 2200/101
(Continued)

(56) References Cited

U.S. PATENT DOCUMENTS 3,662,624 A * 5/1972 Leonard ..... B60Q 1/54 477/111
3,792,791 A * 2/1974 Fleming ..... E02F 9/2246 414/694
(Continued)

FOREIGN PATENT DOCUMENTS

DE 102009054895 A1 6/2011
EP 0559342 A2 2/1993
(Continued)

OTHER PUBLICATIONS

Search Report for related European Application No. 14161139.2; report dated Aug. 25, 2014.
(Continued)

*Primary Examiner* — Mahmoud Gimie
*Assistant Examiner* — Susan E Scharpf
(74) *Attorney, Agent, or Firm* — Murgitroyd & Company

(57) ABSTRACT

A control process for controlling an engine speed governor of an engine is provided. The process comprises the steps of calculating the current engine power being developed by the engine, and determining an appropriate engine speed for the current engine power based upon a first engine map. The process then instructs the speed governor to adjust the engine speed in accordance with the first map if required. The process monitors for desired engine power requests, and calculates a power ratio of desired engine power versus current engine power upon receiving a desired engine power request. The process then establishes an engine speed adjust-
(Continued)

ment value based upon a second engine map of power ratio versus speed adjustment value, and instructs the speed governor to adjust the engine speed in accordance with the speed adjustment value. A speed governor system incorporating the control process, and a work machine or vehicle incorporating such a system are also provided.

13 Claims, 4 Drawing Sheets

(51) Int. Cl.
*F02D 35/00* (2006.01)
*F02D 41/14* (2006.01)

(52) U.S. Cl.
CPC .. *F02D 41/2422* (2013.01); *F02D 2041/1418* (2013.01); *F02D 2200/101* (2013.01); *F02D 2200/1002* (2013.01)

(58) Field of Classification Search
USPC ..... 701/110
See application file for complete search history.

(56) References Cited

U.S. PATENT DOCUMENTS

| | | | | |
|---|---|---|---|---|
| 4,281,567 | A | 8/1981 | Maurer | |
| 4,377,995 | A | 3/1983 | Fiala | |
| 4,459,878 | A | 7/1984 | Frank | |
| 4,580,465 | A | 4/1986 | Omitsu | |
| 4,805,571 | A * | 2/1989 | Humphrey | F01L 1/348 123/25 C |
| 4,984,545 | A * | 1/1991 | Kaneyasu | B60K 31/047 123/352 |
| 5,079,705 | A * | 1/1992 | Sakai | F16H 61/0213 477/120 |
| 5,525,043 | A * | 6/1996 | Lukich | F02D 31/007 417/218 |
| 5,697,339 | A * | 12/1997 | Esposito | F02D 31/007 123/357 |
| 5,845,619 | A * | 12/1998 | Reichlinger | F02D 31/007 123/350 |
| 6,134,499 | A * | 10/2000 | Goode | B60K 31/0008 123/333 |
| 6,189,523 | B1 * | 2/2001 | Weisbrod | F02D 31/002 123/27 GE |
| 6,289,873 | B1 * | 9/2001 | Dunsworth | F02D 31/007 123/352 |
| 6,371,081 | B1 * | 4/2002 | Hawkins | F02D 31/007 123/339.14 |
| 6,839,619 | B2 * | 1/2005 | Bellinger | B60W 30/18 123/330 |
| 7,292,932 | B1 | 11/2007 | Ledger et al. | |
| 2002/0123836 | A1 | 9/2002 | Komiyama et al. | |
| 2007/0028892 | A1 | 2/2007 | Schmid | |
| 2007/0255488 | A1 | 11/2007 | Okubo et al. | |
| 2009/0095545 | A1 * | 4/2009 | Crabtree | B60K 25/02 180/53.8 |
| 2009/0299581 | A1 | 12/2009 | Price | |
| 2010/0042301 | A1 * | 2/2010 | Shimizu | B60W 30/18063 701/58 |
| 2010/0262343 | A1 | 10/2010 | Eriksson et al. | |
| 2011/0195817 | A1 | 8/2011 | Whitney et al. | |
| 2012/0143460 | A1 | 6/2012 | Sugano et al. | |
| 2012/0296536 | A1 | 11/2012 | Lee et al. | |
| 2014/0366840 | A1 * | 12/2014 | Sivasubramanian | F02D 41/0025 123/399 |

FOREIGN PATENT DOCUMENTS

| | | | |
|---|---|---|---|
| EP | 0930424 | A1 | 7/1999 |
| EP | 1157875 | A1 | 5/2001 |
| EP | 2282037 | A1 | 3/2002 |
| EP | 1958835 | A1 | 2/2007 |
| EP | 2340952 | A1 | 2/2007 |
| FR | 2540940 | A1 | 8/1984 |
| GB | 2388924 | A | 5/2001 |
| GB | 2411251 | A | 8/2005 |
| WO | WO-2006/076407 | A1 | 7/2006 |
| WO | WO-2007/042888 | A1 | 10/2006 |
| WO | WO-2007/042904 | A1 | 10/2006 |
| WO | WO-2007/127370 | A1 | 11/2007 |
| WO | WO-2008/018880 | A1 | 2/2008 |
| WO | WO-2011/081866 | A1 | 7/2011 |
| WO | WO-2011/163284 | A1 | 12/2011 |
| WO | WO-2013/120503 | A1 | 8/2013 |

OTHER PUBLICATIONS

International Search Report Application No. PCT/EP2015/052927; dated May 15, 2015.

* cited by examiner

PROCESS AND SYSTEM FOR CONTROLLING ENGINE SPEED

CROSS-REFERENCE TO RELATED APPLICATION

This Application is a 35 USC § 371 US National Stage filing of International Application No. PCT/EP2015/052927 filed on Feb. 12, 2015, and claims priority under the Paris Convention to European Patent Application No. EP 14161139.2 filed on Mar. 21, 2014.

FIELD OF THE DISCLOSURE

The present invention relates to the field of engine control systems, and in particular to a control process and system for controlling a speed governor of an engine.

BACKGROUND OF THE DISCLOSURE

A speed governor controls and adjusts the speed of an engine typically by controlling the amount of fuel supplied to the engine during operation. If the engine is to run at a faster speed more fuel is supplied, whilst less fuel is supplied if the engine speed is to be reduced. Governors are key components of engine control systems, particularly as engine manufacturers seek to develop more efficient engines.

In engine control systems, governors usually receive control signals from an engine controller. Engine controllers monitor numerous input and output parameters of an engine in order to ensure optimum performance of the engine. With the drive towards more and more efficient and economical engines, engine controllers are often now tasked with ensuring that engines are performing at optimum efficiency. This typically involves the engine controller being provided with one or more engine maps to ensure that the engine is operating as efficiently as possible. For example, the engine map may be a map of engine power versus engine speed to ensure that the engine produces a certain engine power at the lowest possible engine speed. The controller can then instruct the governor to adjust the engine speed so that the engine speed remains as low as possible for the required power, as defined by the engine map.

Whilst such control arrangements can improve the efficiency of an engine they have limitations when applied to engines in vehicles which have engine-powered ancillary systems and components, for example. In such vehicles demand for increased engine power from, for example, a hydraulic circuit controlling a tipper bed or bucket can lead to a delay in the increased power being delivered as the engine controller reacts to the demand. It can also mean that the efficiency of the engine is compromised as the controller tries to meet the twin targets of the engine efficiency map and the increased power demanded by the ancillary systems.

It is an aim of the present invention to obviate or mitigate this and other disadvantages with existing engine control systems and/or processes.

SUMMARY OF THE DISCLOSURE

According to a first aspect of the invention there is provided a control process for controlling an engine speed governor of an engine, the process comprising the steps of:

calculating the current engine power being developed by the engine;

determining a minimum engine speed for the current engine power based upon a first map of engine power versus engine speed;

instructing the speed governor to adjust the engine speed in accordance with the first map;

monitoring for desired engine power requests;

calculating a power ratio of desired engine power versus current engine power upon receiving a desired engine power request;

establishing an engine speed adjustment value based upon a second map of power ratio versus speed adjustment value; and instructing the speed governor to adjust the engine speed in accordance with the speed adjustment value.

According to a second aspect of the invention there is provided a speed governor system for an engine having at least one operator input, the system comprising:

a plurality of engine sensors monitoring parameters associated with the engine;

a supervisory controller monitoring the at least one operator input;

an engine controller which receives signals from the engine sensors and/or supervisory controller and applies a control process in response to one or more of those signals, the control process comprising the steps of:

calculating the current engine power being developed by the engine based upon one or more engine sensor signals;

determining a minimum engine speed for the current engine power based upon a first map of engine power versus engine speed;

generating a speed governor signal to adjust the engine speed in accordance with the first map;

monitoring for desired engine power requests;

calculating a power ratio of desired engine power versus current engine power upon receiving a desired engine power request;

establishing an engine speed adjustment value based upon a second map of power ratio versus speed adjustment value;

and the system further comprising:

an engine speed governor which adjusts the speed of the engine in response to the speed governor signal and/or engine speed adjustment value established by the engine controller.

BRIEF DESCRIPTION OF THE DRAWINGS

A preferred embodiment of the present invention will now be described, by way of example only, with reference to the accompany drawings, which are as follows.

DETAILED DESCRIPTION OF THE DISCLOSURE

Figure 1:
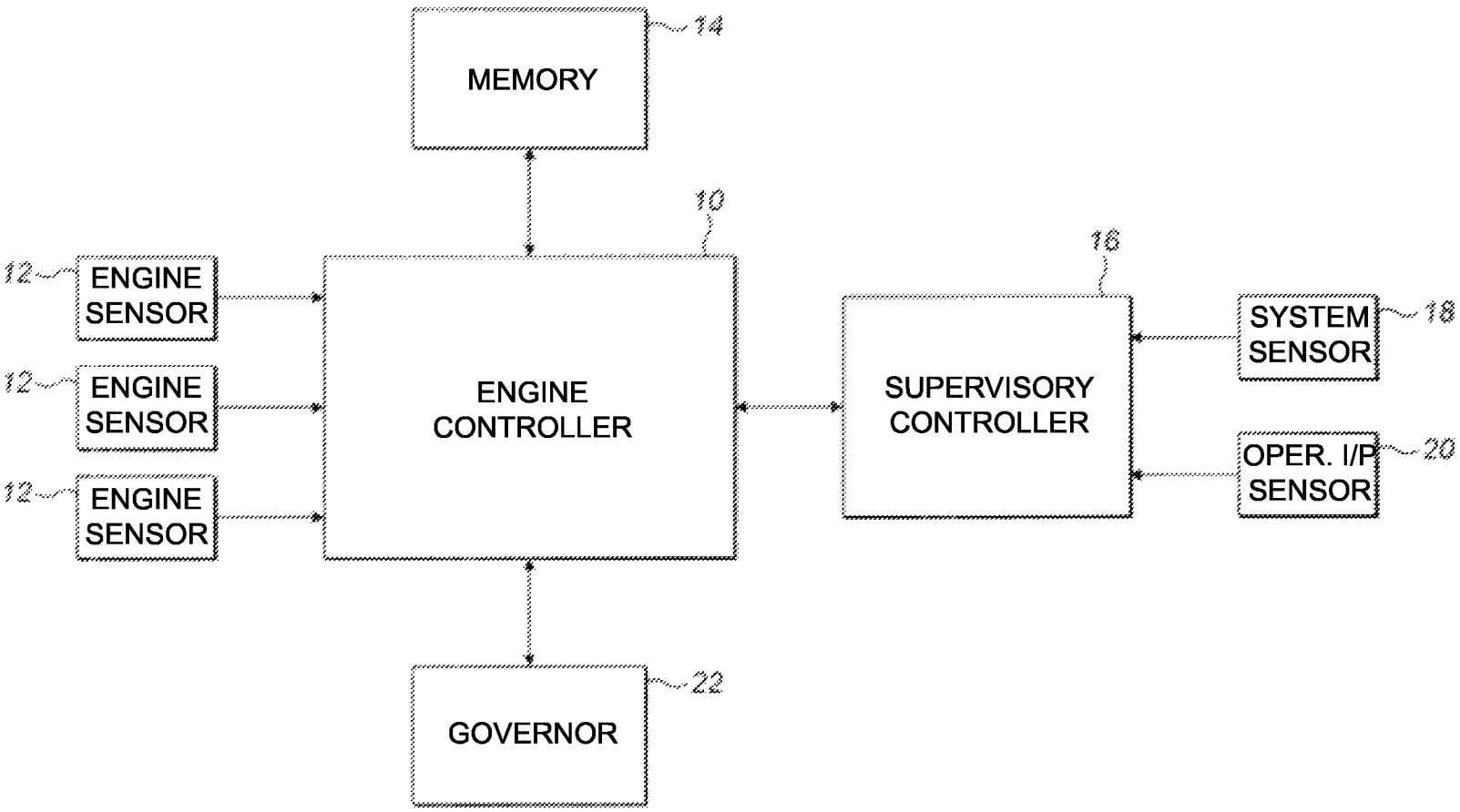
FIG. 1 is a schematic view of a speed governor system.

FIG. 1 shows in schematic form a speed governor control system for controlling the speed of an engine. The system comprises an engine controller 10 which receives data relating to certain engine performance parameters from a plurality of engine sensors 12. The sensors 12 may provide the controller 10 with data relating to various parameters such as, for example: fuel delivery rate, air-fuel ratio (AFR), start of injection (SOI) and engine revolutions per minute (RPM). The controller 12 is also in two-way communication with a memory 14 which stores one or more engine maps relating to, amongst others, the most efficient performance of the engine.

Also in two-way communication with the engine controller 10 is a supervisory controller, or systems controller, 16. The supervisory controller 16 receives data from a plurality of system sensors 18 which monitor various performance aspects of the vehicle within which the engine is mounted. For example, on certain agricultural and construction vehicles such as tractors and bucket loaders there are additional hydraulic systems such as power take off (PTO) units and hydraulic rams for operating buckets and the like. The system sensors 18 monitor the performance of aspects of these auxiliary systems. In addition, the supervisory controller 16 also receives data from at least one operator input sensor 20 which monitors operator control inputs such as, for example, via a throttle pedal or lever. The final component of the system is an engine speed governor 22 which is in two-way communication with the engine controller 10. The governor 22 can adjust the speed of the engine in response to control signals from the engine controller, usually by varying the rate of fuel delivery into the engine.

Figure 2:
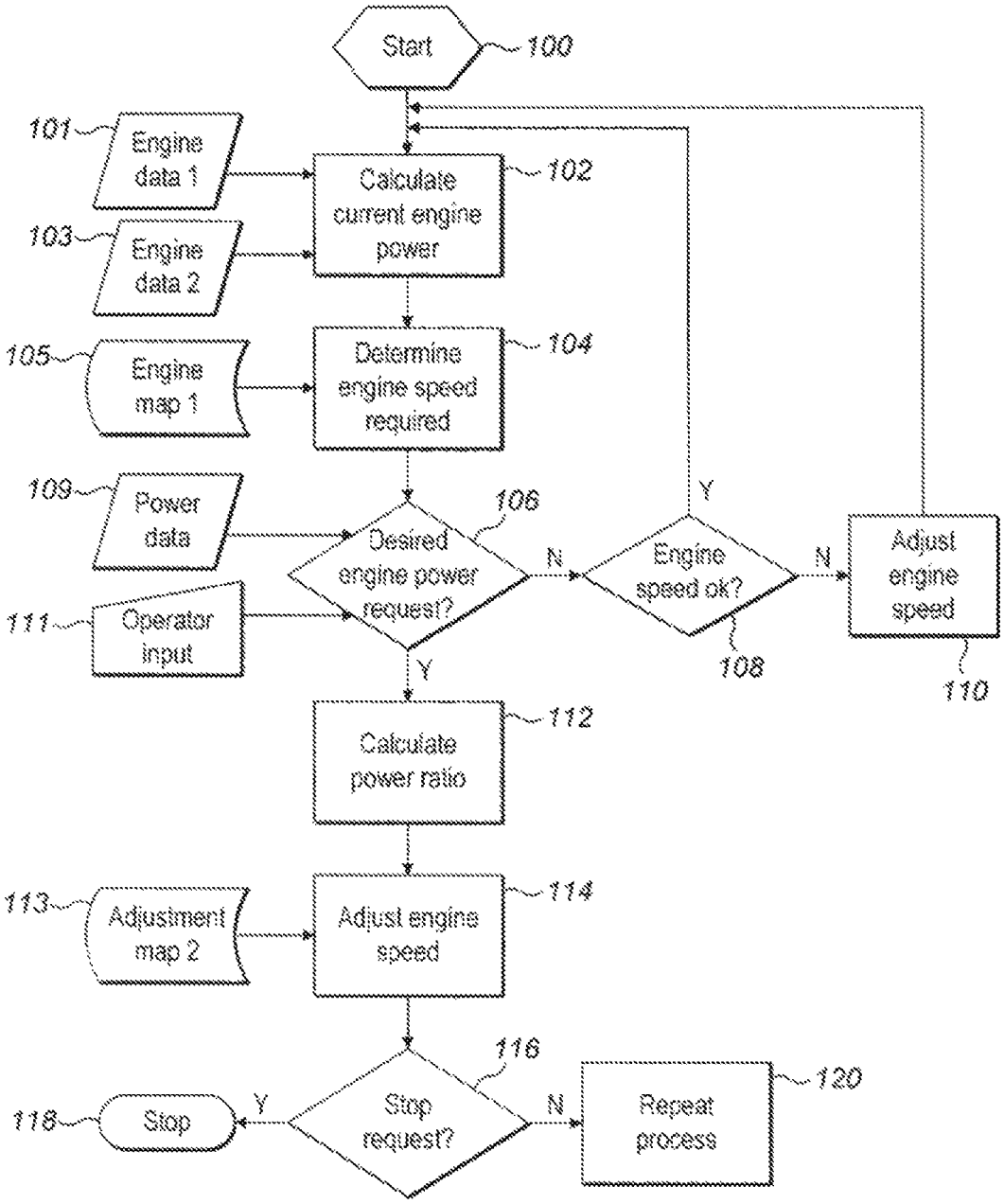
FIG. 2 is a flowchart illustrating a control process for controlling an engine speed governor.
Figure 3:
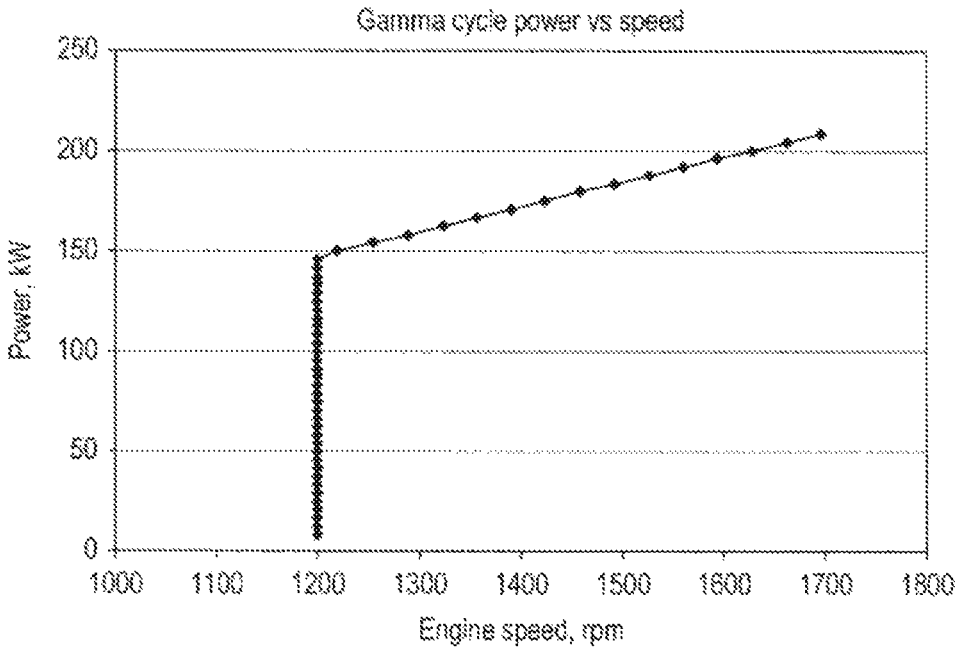
FIG. 3 is a graph illustrating an engine map of power vs. engine speed.

FIG. 2 is a flowchart illustrating the preferred process for controlling the engine speed governor. The process starts at step 100 and the controller 10 then applies determination step 102 so as to determine the current power being generated by the engine based upon engine data 101,103 received from the plurality of engine sensors 12. The controller then applies determination step 104 so as to determine the optimum engine speed required for the current power based on an engine map 105 stored in the system memory 14. An example of a preferred engine map is shown in FIG. 3, which is a preferred efficiency map illustrating the minimum engine speed required to generate a particular engine power.

The controller is also continuously monitoring for signals from the supervisory controller 16 as regards data 109,111 received from the system and/or operator input sensors 18,20. Once the optimum engine speed has been determined at determination step 104 the controller then determines at step 106 whether any data 109,111 received indicates a need for additional power. If no additional power need is determined, a comparison of current engine speed and ideal engine speed in made at decision step 108. If the current speed matches the ideal speed, or is within acceptable limits (e.g. ±5%), the process will loop back to determination step 102. However, if the current engine speed does not match the ideal speed or is outside acceptable limits then the controller will instruct the governor to adjust the engine speed at decision step 110 before looping back to step 102.

If it is determined that additional power is needed at step 106 the controller will calculate the total power required to meet the request and determine a ratio of current power to that total desired power at determination step 112. At a subsequent determination step 114, the controller looks up data in an adjustment map 113 stored in the system memory in order to determine a speed adjustment value which should be sent to the engine governor in order to meet the total desired power value. The table below gives an example of such an adjustment map:

| | Power Ratio | | | | | | | | |
|---|---|---|---|---|---|---|---|---|---|
| | 0.05 | 0.1 | 0.5 | 1 | 2 | 5 | 10 | 15 | 20 |
| Adjustment Value | 0.8 | 0.9 | 0.95 | 1 | 1.05 | 1.1 | 1.2 | 1.3 | 1.4 |

Based on the information in the adjustment map, the controller then instructs the governor to adjust the engine speed in accordance with the appropriate adjustment value.

Finally, the controller determines whether the engine is continuing to run at decision step 116. If the engine has stopped, the process stops at termination step 118. Alternatively, if the engine is still running the process proceeds to repeat step 120 and the process begins again with determination step 102.

FIG. 3 illustrates a preferred engine map of engine power versus engine speed which may be employed with the present invention. As can be seen from the map, an engine controlled in accordance with this map will product an engine power of 1-150 kW at a minimum engine speed of 1200 rpm. If a power greater than 150 kW is required the engine will then speed up with a resultant linear increase in power from 150 kW to approximately 210 kW across an engine speed range of 1200 rpm to 1700 rpm.

Figure 4:
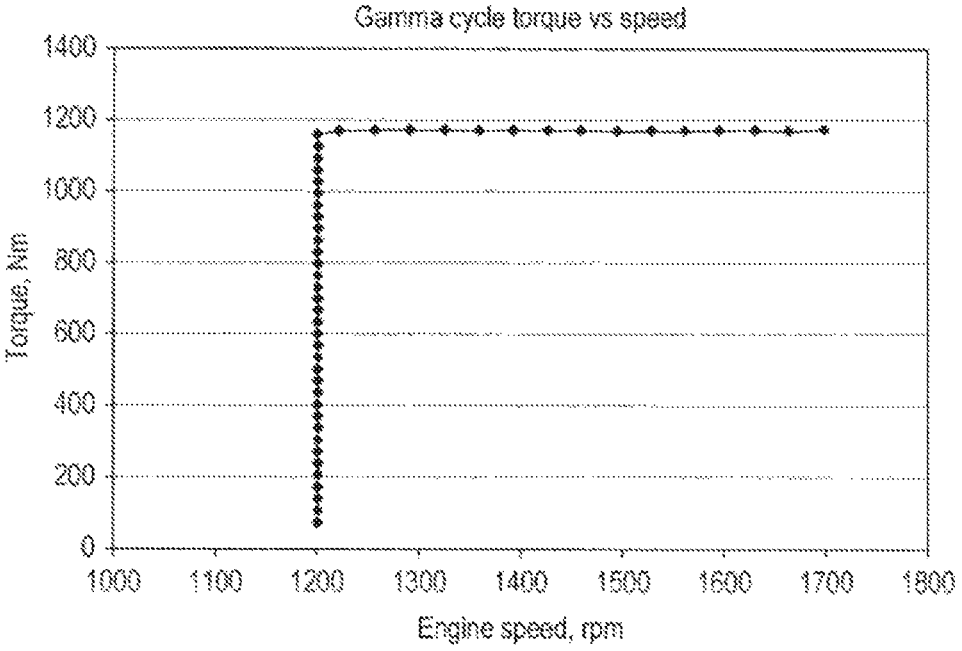
FIG. 4 is a graph illustrating engine torque vs. engine speed when the engine is operating in accordance with the power map of FIG. 3.

FIG. 4 is a graph illustrating the engine torque generated by the engine when operating in accordance with the engine map shown in FIG. 3. As with engine power, a range of torque from 1 to approximately 1180 Nm is available with the engine operating at the 1200 rpm minimum engine speed. As the engine speed increases to increase power as depicted in FIG. 3 the maximum torque will plateau and remain constant at 1180 Nm irrespective of the increase in engine speed.

INDUSTRIAL APPLICABILITY

An example of how the system and process of the present invention would work in practice will now be described.

It should be understood that the present invention could be applied to a wide variety of construction, agricultural and other heavy duty vehicles such as on-highway trucks and buses, agricultural tractors, off-highway trucks, construction and mining vehicles. However, in this preferred example the present invention is being applied to an off-highway articulated tipper truck for use in construction and mining activities, such as the applicant's CAT 725C truck. Such trucks are required to operate over a wide variety of terrain, both inclined and relatively flat, and also must deposit loads carried in their tipper beds at specified locations. A schematic view of such a truck is shown in FIG. 5.

The truck 200 includes an internal combustion engine 202 which is arranged so as to provide motive force for the vehicle as well as powering certain ancillary systems. In this case the engine 202 also powers, amongst other things, the hydraulic system which operates the tipper bed 204. This system includes a pair of hydraulic rams 206, each of which has one end fixed to the truck chassis 208 and the other end attached to the tipper bed 204.

Monitoring various parameters of the engine 202 are a plurality of the engine sensors 12. The supervisory controller 16 monitors for desired power requests from an operator input sensor 20 attached to the throttle pedal 210 of the truck as well as ancillary system sensors 18 monitoring at least the hydraulic rams 206. The engine controller 10 is mounted to the engine 202 and is in communication with the engine sensors 12 and the supervisory controller 16. The speed governor 22 is located on or adjacent the engine so that it may control the flow rate of fuel into the engine in response to signals from the engine controller 10.

Figure 5:
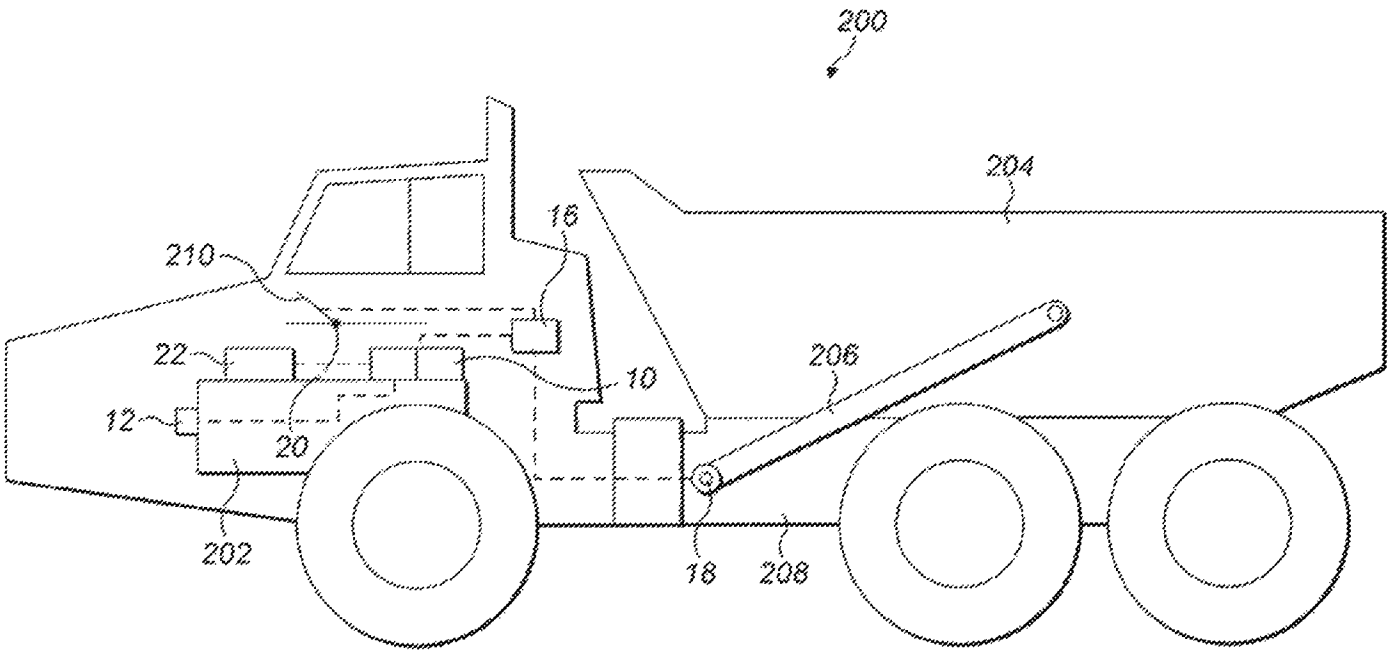
FIG. 5 is a schematic view of an off-highway vehicle incorporating the speed governor system of FIG. 1.

With the system as shown in FIG. 5 on-board the truck, the relevant components of that system are ready to control the truck's engine speed governor in accordance with the process set out in FIG. 2. With the truck operating in basic operating conditions, where it is traversing relatively flat terrain and without the need to operate its tipper bed, the control process will be operating steps 102 to 110 of the process on a continuous loop. Determination step 102 calculates the current power being generated by the truck's engine based on the data 101,103 being received from the engine sensors 12. Once the power figure is calculated the engine map 105 (as shown in FIG. 3) is looked up at determination step 104 in order to establish the minimum engine speed required for the current power.

Once the minimum engine speed has been established the process will decide at decision step 106 whether a request for power has been received from the supervisory controller 16. Such a request would be made based upon data 109,111 received from either one or more of the system sensors 18 and/or the operator input sensor 20. In this example, such a power request may be received if a system sensor determines that additional hydraulic pressure is required to lift the tipper body 204, or if the operator input sensor 20 senses that the vehicle operator is making a manual input via the throttle pedal 210. Additionally, in certain applications where the truck is continually following a predetermined route it may be equipped with a global positioning satellite (GPS) enabled system which is programmed with data relating to the contours of the ground being covered and hence the location of any inclines, for example. In such applications the GPS system may indicate to the supervisory controller that an incline is approaching and the supervisory controller may request additional power from the engine controller.

In the event that no power requests are detected, decision step 108 will decide whether the current engine speed is the ideal engine speed based upon the determination made at step 104 based on the map data 105. If the current engine speed is the ideal speed, or within a predetermined range (e.g. ±5%), then the process will loop back to determination step 102. If the current speed is outside of the predetermined range then the controller instructs the governor to adjust the engine speed at process step 110 before the process loops back to step 102.

If additional power is requested based upon system sensor data or an operator input, then a ratio of the total desired power to the current power is determined at step 112. That ratio is then looked up in the speed adjustment map 113 and the engine speed is adjusted at step 114 based on the adjustment valve established from the map 113.

Finally, the process looks for an engine stop request by the truck operator at decision step 116, and either stops the process at termination step 118 or else beings to repeat the process from the beginning via step 120.

The system and process of the present invention ensure that the engine of a vehicle can be run at its most efficient (i.e. lowest) speed for a particular engine power. They also ensure that the engine reacts quickly to additional power demands which may be required for ancillary systems on the particular vehicle in which the engine is operating. However, during the periods of additional power demands the present invention ensures that the engine is still running at its optimum efficiency without running the engine at greater speeds (and fuel consumption) than necessary and without having to accelerate the engine quickly to generate more power due to an unexpected power demand from some system on the vehicle.

Modifications and improvements may be incorporated without departing from the scope of the invention.

The invention claimed is:

1. A control process for controlling an engine speed governor of an engine, the process comprising the steps of:

calculating the current engine power being developed by the engine;

determining an appropriate engine speed for the current engine power based upon a first engine map, the appropriate engine speed defined by the first engine map being a minimum speed for the current engine power;

instructing the speed governor to adjust the engine speed from a current engine speed to the appropriate engine speed in accordance with the first map if required;

monitoring for a request for additional power above the current engine power;

calculating a power ratio of total desired engine power to the current engine power if the request for additional power above the current engine power is received;

comparing the calculated power ratio to a second engine map correlating speed adjustment values to predetermined power ratios of total desired engine power to current engine power to determine a speed adjustment value correlated to the calculated power ratio, the speed adjustment value specifying a minimum engine speed to meet the request for additional power; and instructing the speed governor to adjust the engine speed in accordance with the speed adjustment value.

2. The process of claim 1, wherein the speed governor is only instructed to adjust the engine speed in accordance with the first map if a difference between an actual engine speed and the appropriate engine speed is greater than 5% of the appropriate engine speed as determined by the first map.

3. The process of claim 1, wherein the engine drives a work machine or vehicle and the request for additional power is received from one or more ancillary components located on the work machine or vehicle, a manual operator input made by an operator of the vehicle, or both.

4. The process of claim 3, wherein the one or more ancillary systems are selected from the group comprising: a power take-off unit, a hydraulically-actuated component, or a global positioning satellite system.

5. A speed governor system for an engine, the system comprising:

a plurality of engine sensors monitoring parameters associated with the engine;

a supervisory controller monitoring for a request for additional power above a current engine power being developed by the engine;

an engine controller which receives signals from the engine sensors, the supervisory controller, or both, and applies a control process in response to one or more of those signals, the control process comprising the steps of:

calculating the current engine power being developed by the engine based upon one or more engine sensor signals;

determining an appropriate engine speed for the current engine power based upon a first engine map, the appropriate engine speed defined by the first engine map being a minimum speed for the current engine power;

generating a speed governor signal to adjust the engine speed from a current engine speed to the appropriate engine speed in accordance with the first map if required;

monitoring for the request for additional power from the supervisory controller;

calculating a power ratio of total desired engine power to the current engine power if the request for additional power from the supervisory controller is received; and comparing the calculated power ratio to a second engine map correlating speed adjustment values to predetermined power ratios of total desired engine power to current engine power to determine a speed adjustment value correlated to the calculated power ratio, the speed adjustment value specifying a minimum engine speed to meet the request for additional power;

and the system further comprising:

an engine speed governor which adjusts the speed of the engine in response to the speed governor signal, the speed adjustment value established by the engine controller, or both.

6. The system of claim 5, further comprising at least one operator input sensor and at least one ancillary system sensor, wherein the supervisory controller receives the request for additional power from one or more of these operator input and ancillary system sensors.

7. A work machine or vehicle comprising a speed governor system for an engine in accordance with claim 6, further comprising at least one operator input device, wherein the at least one operator input sensor monitors the operator input device.

8. The work machine or vehicle of claim 7, further comprising at least one ancillary system selected from the group comprising: a power take-off unit, a hydraulically-actuated component, or a global positioning satellite system; and wherein the at least one ancillary system sensor monitors the at least one ancillary system.

9. A work machine or vehicle comprising a speed governor system for an engine in accordance with claim 5.

10. A control process for controlling an engine speed governor of an engine, the process comprising the steps of:

calculating the current engine power being developed by the engine;

determining an appropriate engine speed for the current engine power based upon a first engine map, the appropriate engine speed defined by the first engine map being a minimum speed for the current engine power;

monitoring for a request for additional power above the current engine power;

in response to determining that no additional power is needed based on monitoring for the request for additional power:

instructing the speed governor to adjust the engine speed from a current engine speed to the appropriate engine speed from the first map if the current engine speed is different than the appropriate engine speed;

in response to receiving the request for additional power:

calculating a power ratio of total desired engine power to the current engine power, comparing the calculated power ratio to a second engine map correlating speed adjustment values to predetermined power ratios of total desired engine power to current engine power to determine a speed adjustment value correlated to the calculated power ratio, the speed adjustment value specifying a minimum engine speed to meet the request for additional power, and instructing the speed governor to adjust the engine speed in accordance with the speed adjustment value from the second engine map.

11. The process of claim 10, wherein the speed governor is only instructed to adjust the engine speed in accordance with the first map if the difference between the current engine speed and the appropriate engine speed is greater than 5% of the appropriate engine speed.

12. The process of claim 10, wherein the engine drives a work machine or vehicle and the request for additional power is received from one or more ancillary components located on the work machine or vehicle, a manual operator input made by an operator of the vehicle, or both.

13. The process of claim 12, wherein the one or more ancillary systems are selected from the group comprising: a power take-off unit, a hydraulically-actuated component, or a global positioning satellite system.

* * * * *